US012396562B2

(12) United States Patent
Ge

(10) Patent No.: US 12,396,562 B2
(45) Date of Patent: Aug. 26, 2025

(54) TRAVEL PILLOW

(71) Applicant: Ningbo Usun Products Design Co., Ltd., Ningbo (CN)

(72) Inventor: Wenguo Ge, Ningbo (CN)

(73) Assignee: NINGBO USUN PRODUCTS DESIGN CO., LTD., Ningbo (CN)

( * ) Notice: Subject to any disclaimer, the term of this patent is extended or adjusted under 35 U.S.C. 154(b) by 293 days.

(21) Appl. No.: 18/198,860

(22) Filed: May 18, 2023

(65) Prior Publication Data

US 2023/0284782 A1 Sep. 14, 2023

Related U.S. Application Data

(63) Continuation-in-part of application No. PCT/CN2021/135249, filed on Dec. 3, 2021.

(30) Foreign Application Priority Data

Feb. 5, 2021 (CN) ..... 202110162694.9

(51) Int. Cl.
*A47C 7/38* (2006.01)
*A47G 9/10* (2006.01)

(52) U.S. Cl.
CPC ..... *A47C 7/383* (2013.01); *A47G 9/1009* (2013.01); *A47G 9/1081* (2013.01)

(58) Field of Classification Search
CPC .. A47C 7/36; A47C 7/38; A47C 7/383; A47C 7/386; A47G 9/10; A47G 9/1009; A47G 9/1081; A47G 2009/1018
See application file for complete search history.

(56) References Cited

U.S. PATENT DOCUMENTS 3,283,344 A * 11/1966 Blanchard ..... A47G 9/1009 5/639
6,305,749 B1 * 10/2001 O'Connor ..... B60N 2/868 5/636
6,640,367 B2 * 11/2003 Hsia ..... A47G 9/1009 5/636
8,898,840 B1 * 12/2014 Majette ..... A47C 7/383 5/643
9,615,682 B1 * 4/2017 Maddocks ..... B60N 2/5664
2002/0185573 A1 * 12/2002 Bisch ..... B60N 2/882 248/118

(Continued)

*Primary Examiner* — George Sun
(74) *Attorney, Agent, or Firm* — MATTHIAS SCHOLL P.C.; Matthias Scholl

(57) ABSTRACT

A travel pillow includes a mounting assembly and a main body. The main body includes a U-shaped case detachably connected to the mounting assembly. The mounting assembly includes a cover, a U-shaped filler, and an inner frame. The cover, the U-shaped filler, and the inner frame are disposed sequentially from outside to inside; and the U-shaped filler is detachably attached to the U-shaped case. The inner frame includes an arc-shaped support body and two arms; two ends of the arc-shaped support body include two first knuckles, respectively; and the travel pillow further includes two rotary connectors connected to the two first knuckles, respectively; each arm includes a second knuckle. The first knuckle includes a through hole; each rotary connector includes a rotating shaft and a nut. The rotating shaft includes a threaded end and a rotating part.

6 Claims, 16 Drawing Sheets

(56) References Cited

U.S. PATENT DOCUMENTS

| | | | | |
|---|---|---|---|---|
| 2003/0135927 | A1* | 7/2003 | Hsia | A47G 9/1009 5/643 |
| 2004/0217639 | A1* | 11/2004 | Clough | A47C 7/38 297/391 |
| 2017/0071349 | A1* | 3/2017 | Wong | A47C 7/383 |
| 2020/0060450 | A1* | 2/2020 | Wong | A47C 27/20 |
| 2020/0221887 | A1* | 7/2020 | Jamil | A47G 9/1009 |

* cited by examiner

TRAVEL PILLOW

CROSS-REFERENCE TO RELATED APPLICATIONS

This application is a continuation-in-part of International Patent Application No. PCT/CN2021/135249 with an international filing date of Dec. 3, 2021, designating the United States, now pending, and further claims foreign priority benefits to Chinese Patent Application No. 202110162694.9 filed Feb. 5, 2021. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, MA 02142.

BACKGROUND

The disclosure relates to the field of household goods, and more particularly, to a travel pillow.

Conventionally, a U-shaped travel pillow includes a cloth cover and an inner lining formed integrally with the cloth cover. When the cloth cover is dirty, it is difficult to clean, disassemble, and replace.

SUMMARY

To achieve the aforesaid objective, the disclosure provides a travel pillow in the shape of the letter U; the travel pillow comprises a mounting assembly and a main body; and the main body comprises a U-shaped case detachably connected to the mounting assembly. The mounting assembly comprises a cover, a U-shaped filler, and an inner frame; the cover, the U-shaped filler, and the inner frame are disposed sequentially from outside to inside; and the U-shaped filler is detachably attached to the U-shaped case; the inner frame comprises an arc-shaped support body and two arms; two ends of the arc-shaped support body comprise two first knuckles, respectively; and the travel pillow further comprises two rotary connectors connected to the two first knuckles, respectively; each arm comprises a second knuckle; the first knuckle comprises a through hole; each rotary connector comprises a rotating shaft and a nut; the rotating shaft comprises a threaded end and a rotating part; the threaded end is in threaded connection to the nut; and the rotating shaft is disposed in the through hole; the first knuckle is disposed between the nut and the second knuckle; and the rotating part is disposed in the second knuckle; and the two arms are rotatably disposed on both ends of the arc-shaped support body, respectively; and an included angle between the arc-shaped support body and each arm is adjustable.

The term "detachably connected" refers to a connection mean that provides detachable connectors for joining different parts together and hence allow low-cost replacement of specific parts, thus allowing for easy assembly and disassembly of the travel pillow, and allowing easy cleaning and replacement of the mounting assembly and the U-shaped case. The cover is configured to protect the U-shaped filler and the inner frame from being damaged, and cover a plurality of connectors disposed on the U-shaped filler to give an improved visual aesthetic. The U-shaped filler is configured to specify locations of the U-shaped inner frame and the cover, allowing easy assembly of the travel pillow and making the travel pillow softer. The inner frame is configured to support the main body and the U-shaped filler, thus allowing for easy assembly of the travel pillow.

The arc-shaped support body is configured to prop up the user's neck; the two arms are rotated to fit a diverse range of neck shapes and transmit pressure from the arc-shaped support body to the main body, thus improving user's comfort and protecting the inner frame from damage caused by an applied force. The included angle is rotatable to protect the two arms and the arc-shaped support body from damage caused by an applied force.

In a class of this embodiment, the mounting assembly is U-shaped and comprises an inner surface in contact with the U-shaped case; and the U-shaped case comprises an outer surface fitting in with the inner surface.

The mounting assembly is matched with the U-shaped case in shape and detachably attached thereto.

In a class of this embodiment, the cover comprises an arc-shaped middle and two end parts; and the two end parts are formed integrally with or detachably connected to the arc-shaped middle.

An integral formation process reduces number of components and greatly reduces manufacturing time; and a detachable connection allows for easy maintenance of the inner frame and rapid replacement of the two arms or the arc-shaped support body.

In a class of this embodiment, the U-shaped filler is detachably connected to the U-shaped case through a zipper; and the U-shaped filler comprises silicone or rubber.

The silicone or rubber is stiffer than a sponge or a cloth, and enables a stable bolt connection among the U-shaped filler, the cover, and the inner frame; the silicone or rubber improves comfort and prop for a user's neck; and the U-shaped filler is detachably connected to the U-shaped case, which allows easy cleaning or replacement of the U-shaped case.

In a class of this embodiment, the U-shaped filler comprises a first groove; the arc-shaped support body comprises a first protrusion; and the first groove is detachably connected to the first protrusion.

When the first groove is detachably connected to the first protrusion, the U-shaped filler is fixed on the arc-shaped support body, which allows for easy assembly and disassembly of the travel pillow.

In a class of this embodiment, the U-shaped filler further comprises a second groove; each of the two arms comprises a second protrusion; the second protrusion is detachably disposed in the second groove.

When the second protrusion is detachably disposed in the second groove, the corresponding arm is fixed on the U-shaped filler, which allows for easy assembly and disassembly of the travel pillow.

Each rotary connector is configured to control an included angle between the arc-shaped support body and a corresponding arm; and the included angle is controlled to fit a diverse range of neck shapes, thus improving user's comfort.

The following advantages are associated with the travel pillow of the disclosure; 1. The U-shaped case is detachably connected to the mounting assembly, which allows easy cleaning, disassembly, and replacement of the travel pillow; 2. The travel pillow is easy to store when not in use; 3. The two arms are rotatable, thus fitting a diverse range of neck shapes; 4. The U-shaped filler comprises silicone whose elasticity and softness enables a stable detachable connection between the inner frame and the cover, thus improving user's comfort; and 5. The travel pillow is an ergonomic pillow designed to keep user's head and spine in a neutral position, help reducing neck and shoulder pain.

Figure 1:
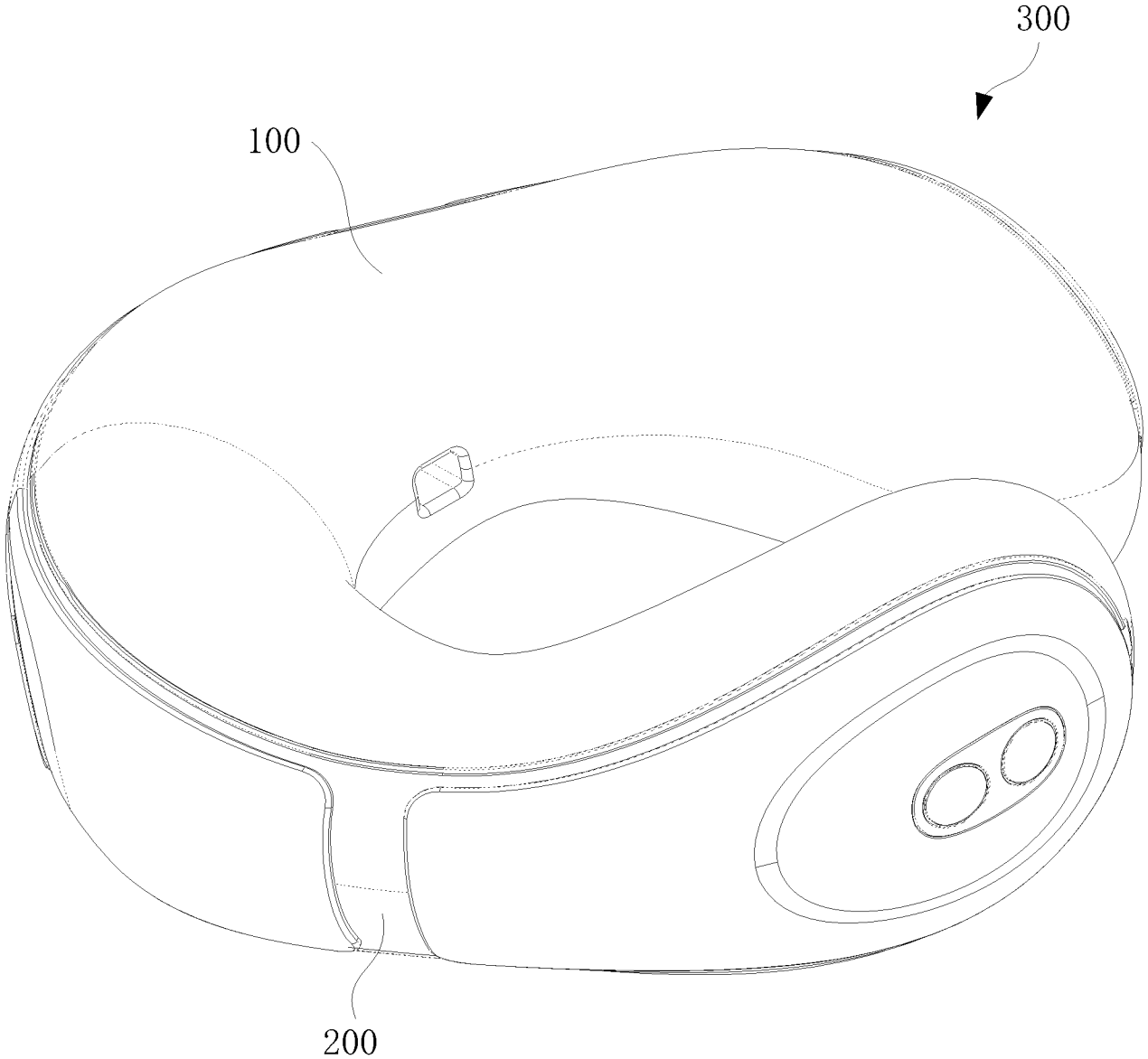
FIG. 1 is a perspective view of a travel pillow according to one example of the disclosure.

In the drawings, the following reference numbers are used: 100. U-shaped case; 200. Mounting assembly; 210. Cover; 210*a*. Arc-shaped middle; 210*b*. End part; 220. U-shaped filler; 220*a*. Hang tab; 221. First groove; 222. Second groove; 230. Inner frame; 231. Arc-shaped support body; 231*a*. First protrusion; 231*b*. First knuckle; 232. Arm; 232*a*. Second protrusion; 232*b*. Second knuckle; 233. Rotating shaft; 233*a*. Threaded end; 233*b*. Rotating part; 234. Nut; and 300. Travel pillow.

DETAILED DESCRIPTION

To further illustrate the disclosure, embodiments detailing a travel pillow are described below. It should be noted that the following embodiments are intended to describe and not to limit the disclosure.

FIG. 1 is a perspective view of a travel pillow 300 according to Example 1 of the disclosure. The travel pillow 300 is U-shaped and comprises a notch for receiving the neck and head of a user, thus providing a natural resting position for improving neck and upper back pain of the user.

Figure 2:
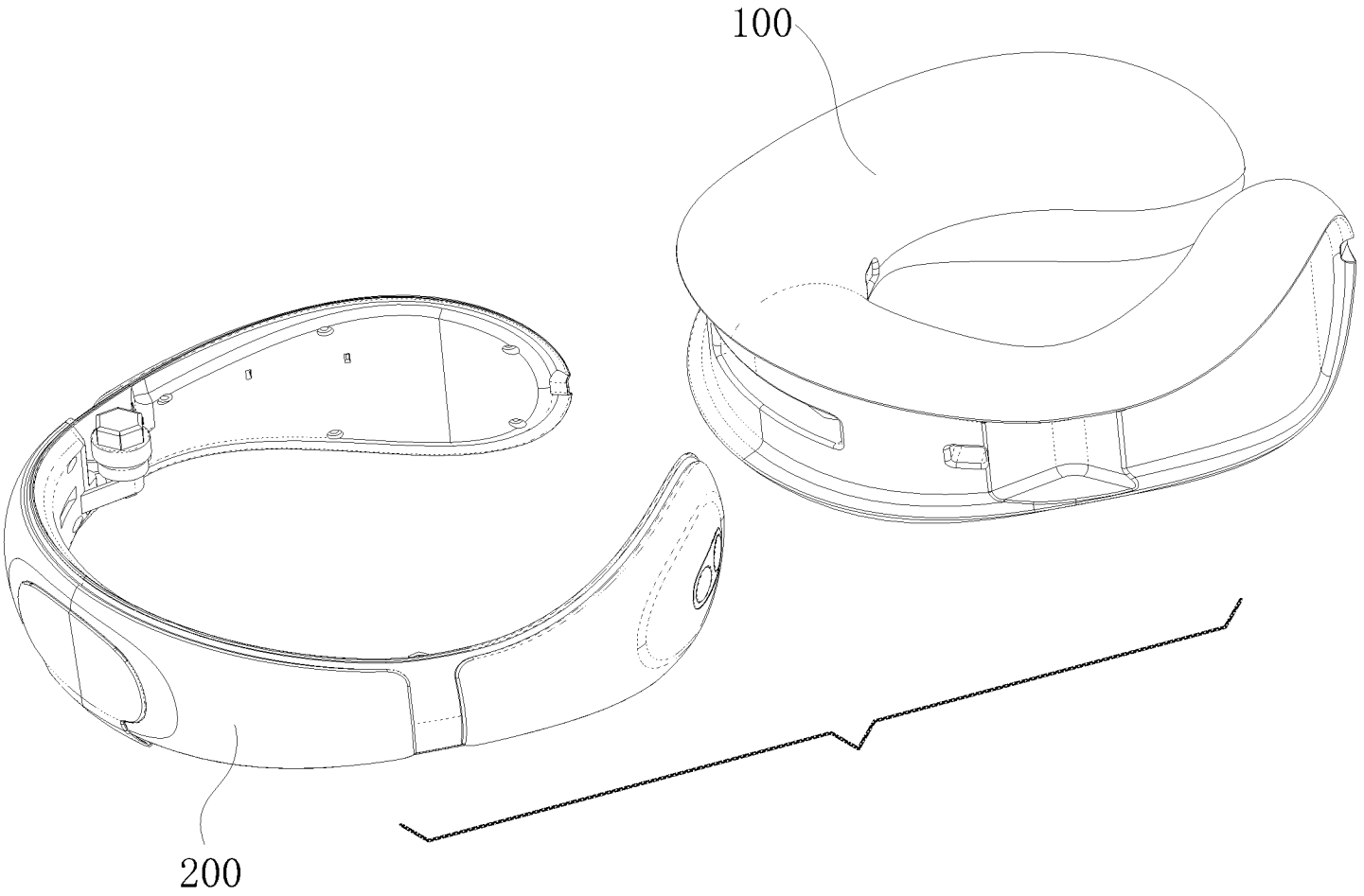
FIG. 2 is an exploded view of a travel pillow according to one example of the disclosure.

As shown in FIG. 2, the travel pillow 300 comprises a mounting assembly 200 and a main body (not shown). The main body comprises a U-shaped case 100 detachably connected to the mounting assembly 200 to allow for easy assembly and disassembly of the travel pillow 300, thus allowing easy cleaning and replacement of the mounting assembly 200 and the main body. The term "detachably connected" refers to connection means that provide detachable connectors for joining different parts together and hence allow low-cost replacement of specific parts.

Referring to FIGS. 1-2, the mounting assembly 200 is U-shaped and comprises an inner surface in contact with the U-shaped case. The U-shaped case comprises an outer surface fitting in with the inner surface. The mounting assembly 200 is matched with the U-shaped case 100 in shape and it can be detachably attached thereto by any suitable connection means such as zippers, buttons, and clamps. The detachable connection means allow for easy assembly and disassembly of the travel pillow, allow cleaning and replacement of the main body or the U-shaped case 100.

Figure 3:
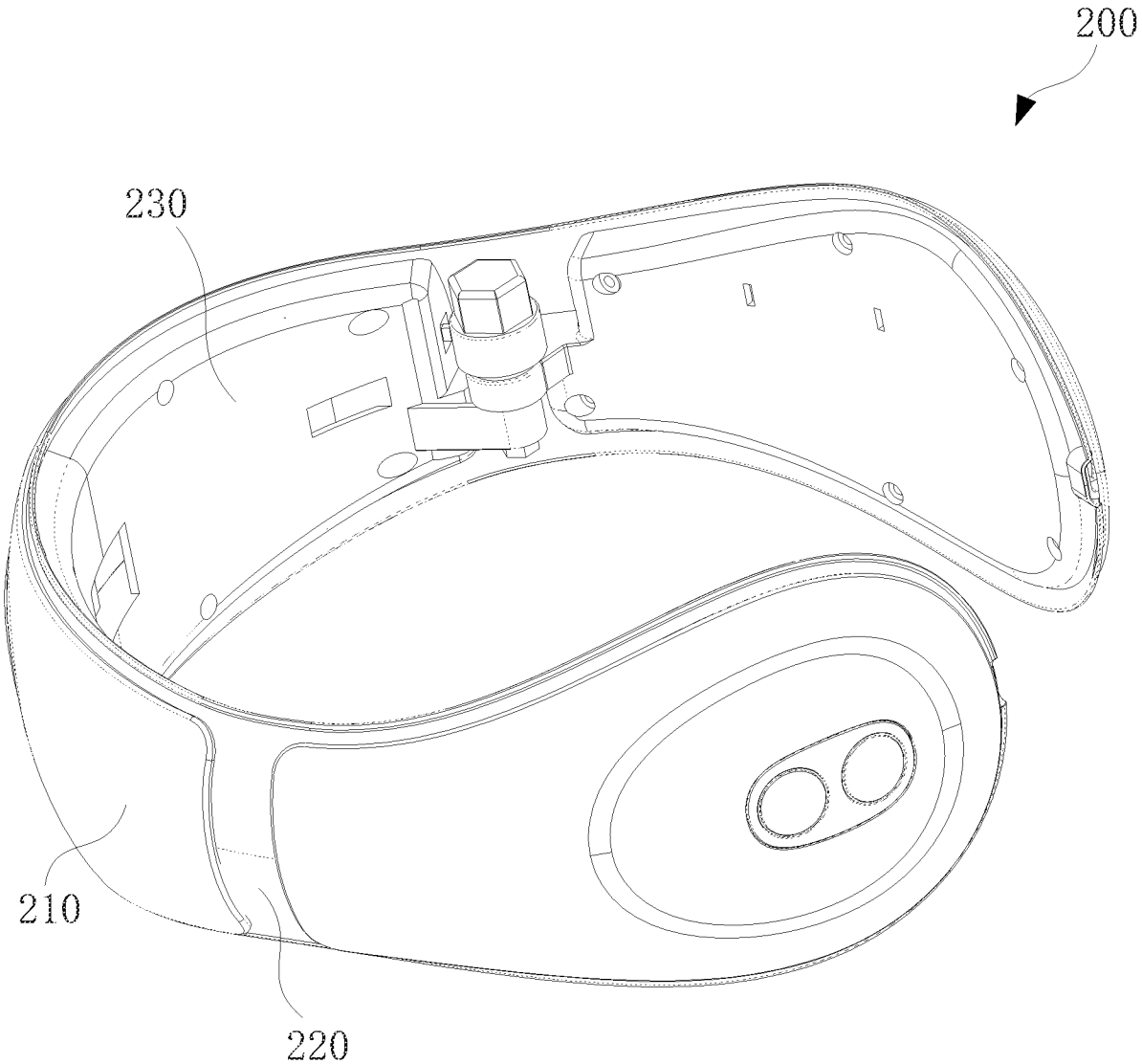
FIG. 3 is a perspective view of a mounting assembly according to one example of the disclosure.
Figure 4:
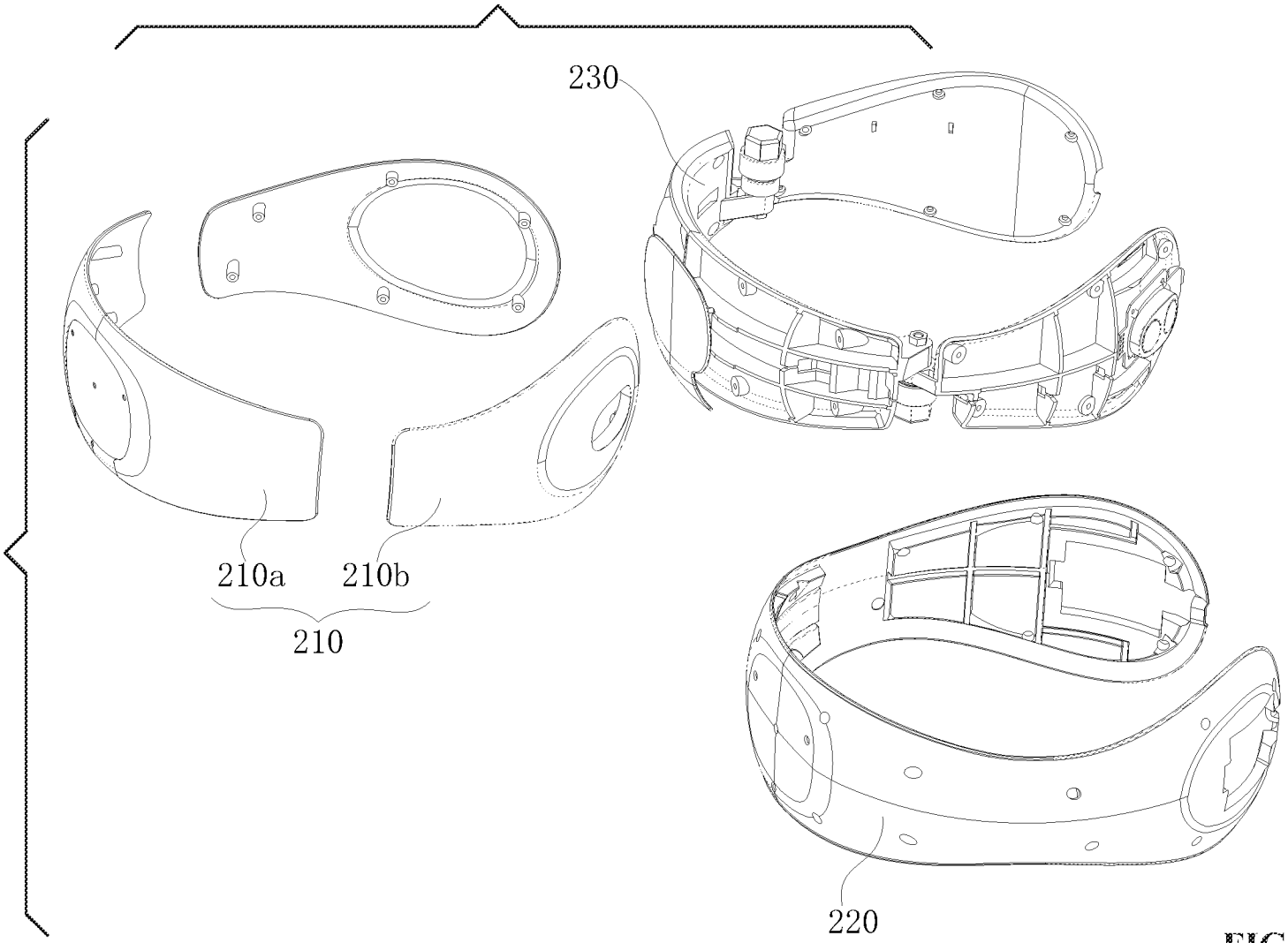
FIG. 4 is an exploded view of a mounting assembly according to one example of the disclosure.

As shown in FIGS. 3-4, the mounting assembly 200 comprises a cover 210, a U-shaped filler 220, and an inner frame 230. The cover 210, the U-shaped filler 220, and the inner frame 230 are disposed sequentially from outside to inside so as to protect the neck of the user. The U-shaped filler 220 is detachably attached to the U-shaped case 100. The cover 200 is configured to protect the U-shaped filler 220 and the inner frame 230 from being damaged. The cover 210 comprises an arc-shaped middle 210*a* and two end parts 210*b*. The cover 210 covers a plurality of connectors (not shown) disposed on the U-shaped filler 220 to give an improved visual aesthetic. The arc-shaped middle 210*a* is configured to protect the U-shaped filler 220 from being damaged. Each end part is configured to protect the corresponding arm from being damaged. The cover 210, the U-shaped filler 220, and the inner frame 230 are successively connected by the plurality of connectors, which allows for easy attachment and detachment of the cover 210 and the inner frame 230. The U-shaped filler 220 is configured to improve user's comfort. The inner frame 230 is configured to support the main body and the U-shaped filler 220, thus allowing for easy assembly of the travel pillow 300.

Figure 8:
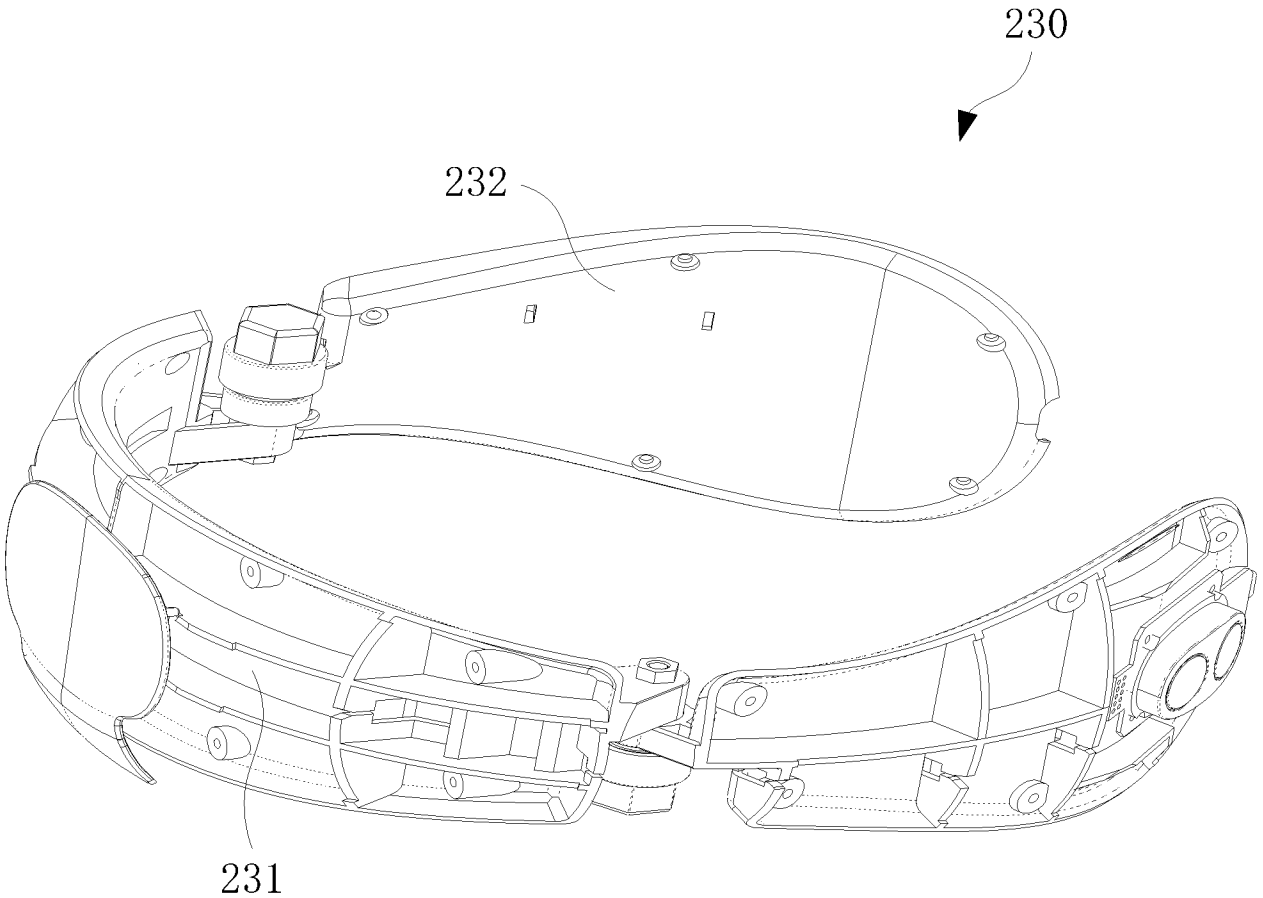
FIG. 8 is a perspective view of an inner frame according to one example of the disclosure.

Referring to FIG. 8, the inner frame 230 comprises an arc-shaped support body 231 and two arms 232; the two arms 232 are rotatably disposed on both ends of the arc-shaped support body 231, respectively. An included angle between the arc-shaped support body 231 and each arm is adjusted to satisfy the requirement of the user. The arc-shaped support body 231 is configured to prop up the user's neck. The two arms 232 are rotated to transmit pressure from the arc-shaped support body 231 to the main body so as to adjust an opening of the main body for receiving the neck of the user, thus improving user's comfort.

Referring to FIG. 4, the cover 210 comprises an arc-shaped middle 210*a* and two end parts 210*b*; the two end parts 210*b* are formed integrally with the arc-shaped middle 210*a* or detachably connected thereto by a bolted joint or a snap-fit joint; a detachable connection allows for easy maintenance of the inner frame 230 and rapid replacement of the two arms 232 or the arc-shaped support body 231; an integral formation is performed through a stamping process, reducing number of components and greatly reducing manufacturing time. The cover 210 comprises a rigid-plastic material or a stiff metal material for protecting the U-shaped filler 220 and the arc-shaped support body 231 from being damaged.

Figure 5:
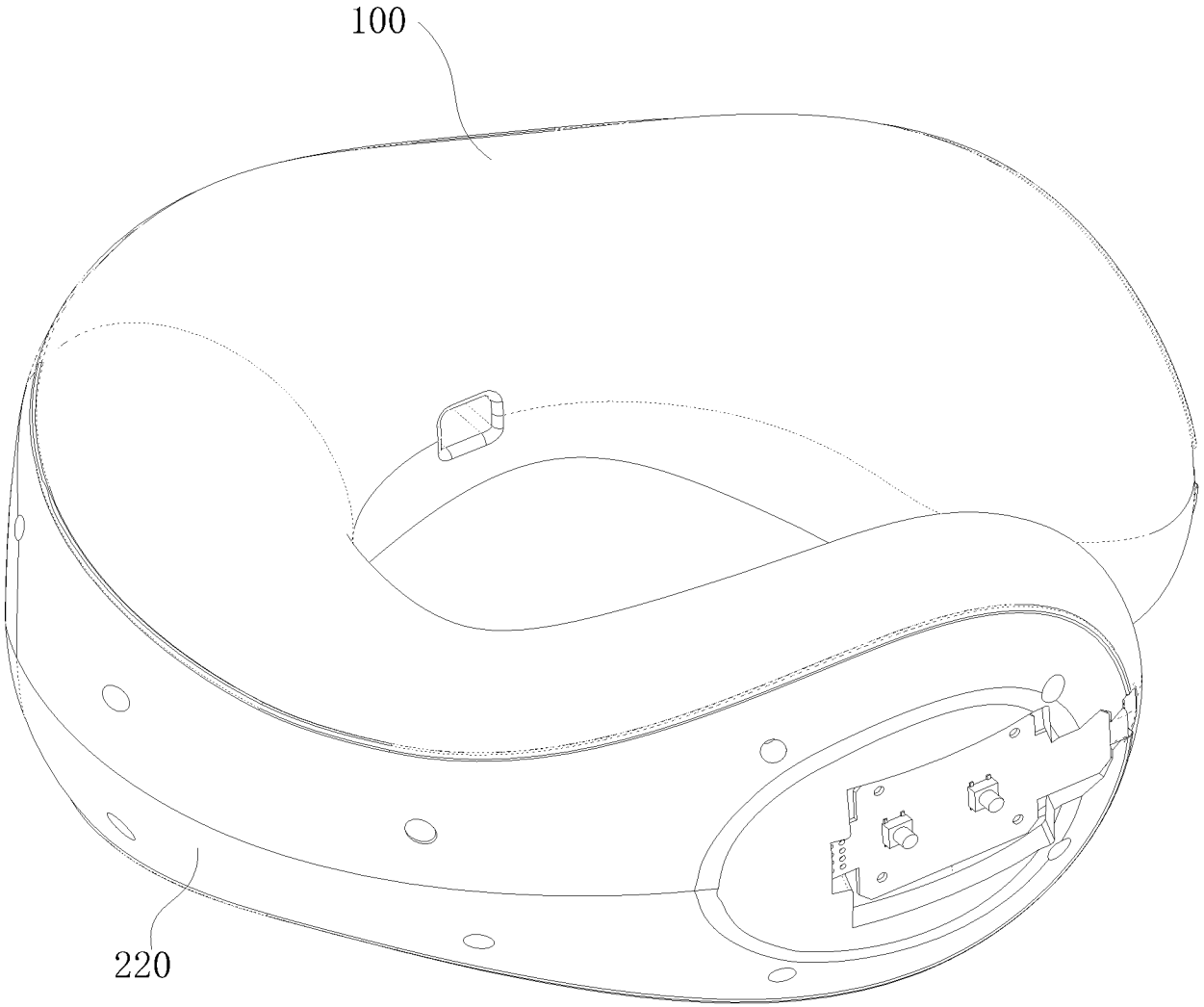
FIG. 5 is a perspective view of a combination of a U-shaped filler and a U-shaped case according to one example of the disclosure.
Figure 6:
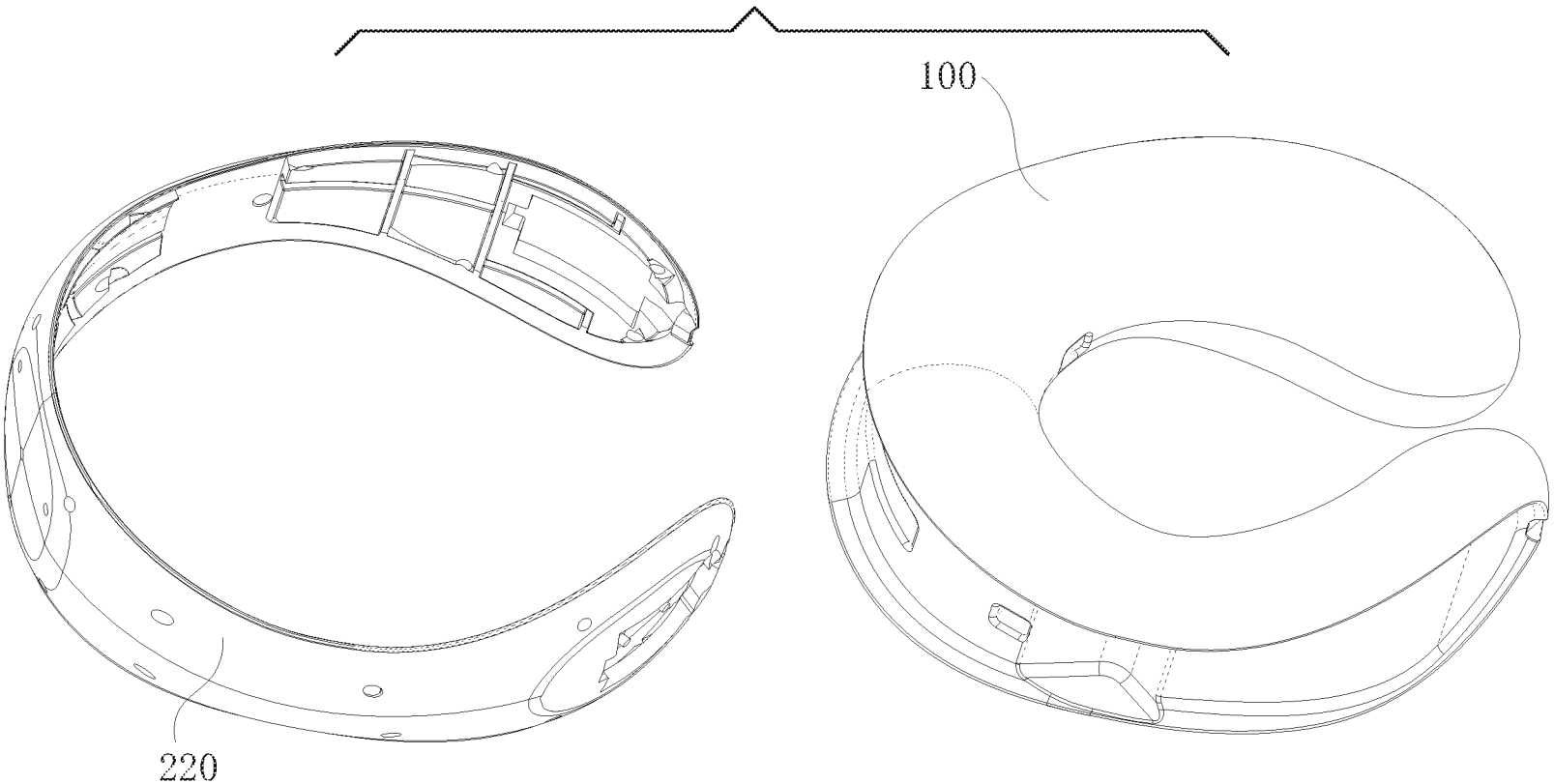
FIG. 6 is an exploded view of a combination of a U-shaped filler and a U-shaped case according to one example of the disclosure.

Referring to FIGS. 5 and 6, the U-shaped filler 220 is detachably connected to the U-shaped case 100 through a zipper or a button; the zipper comprises nylon, resin, or metal; the zipper or the button is low cost, easy to manufacture, and allows for disassembly and replacement of the U-shaped filler 220 and the U-shaped case 100; the U-shaped filler 220 comprises an elastic material such as silicone or rubber, which is stiffer than a sponge or a cloth; the elastic material enables a stable bolt connection among the U-shaped filler 220, the cover 210, and the inner frame 230; as the two arms 232 rotates relative to the arc-shaped support body 231, the elastic material stretches and does not tear easily, compared to the cloth material; the silicone or rubber improves comfort and prop for a user's neck; and the U-shaped filler 220 is detachably connected to the U-shaped case 100, which allows easy cleaning or replacement of the U-shaped case 100.

Figure 7:
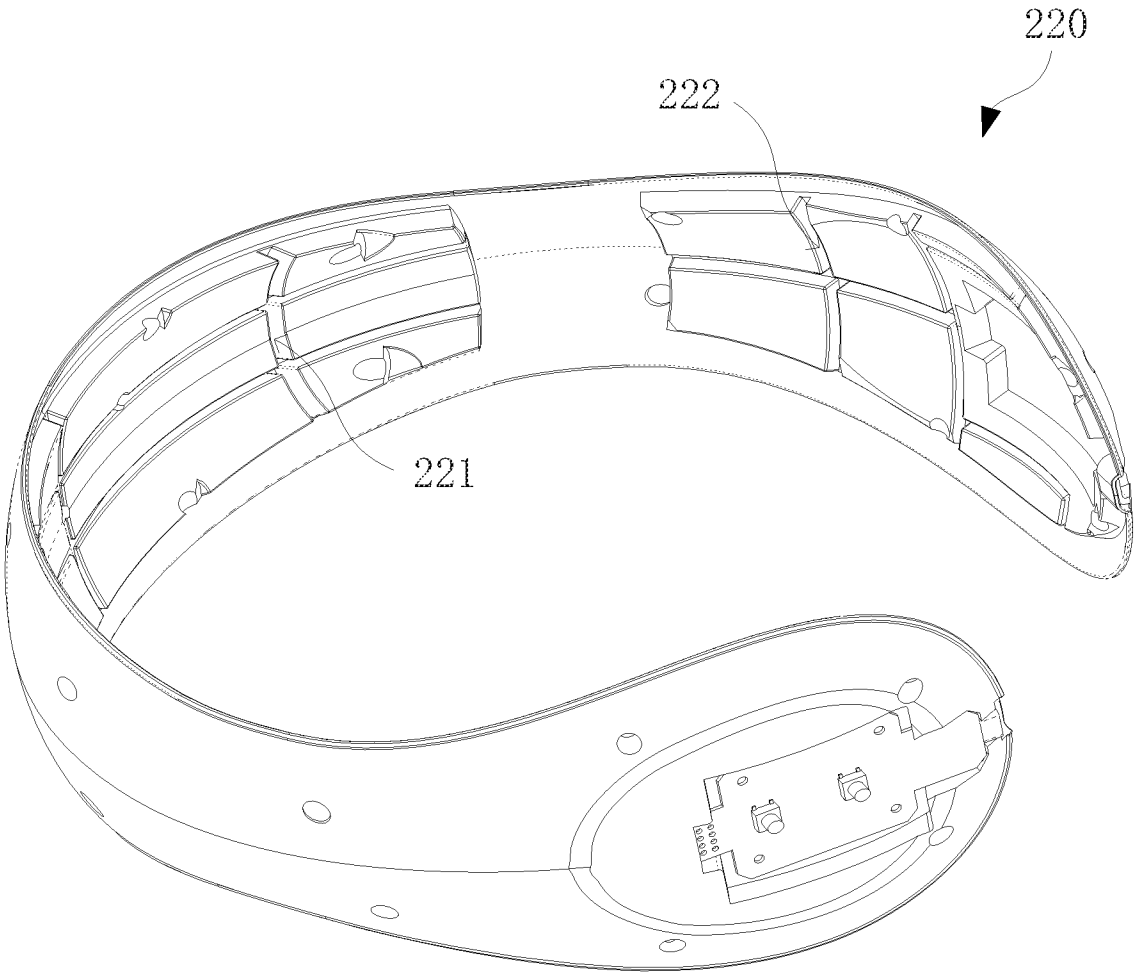
FIG. 7 is a perspective view of a U-shaped filler according to one example of the disclosure.
Figure 9:
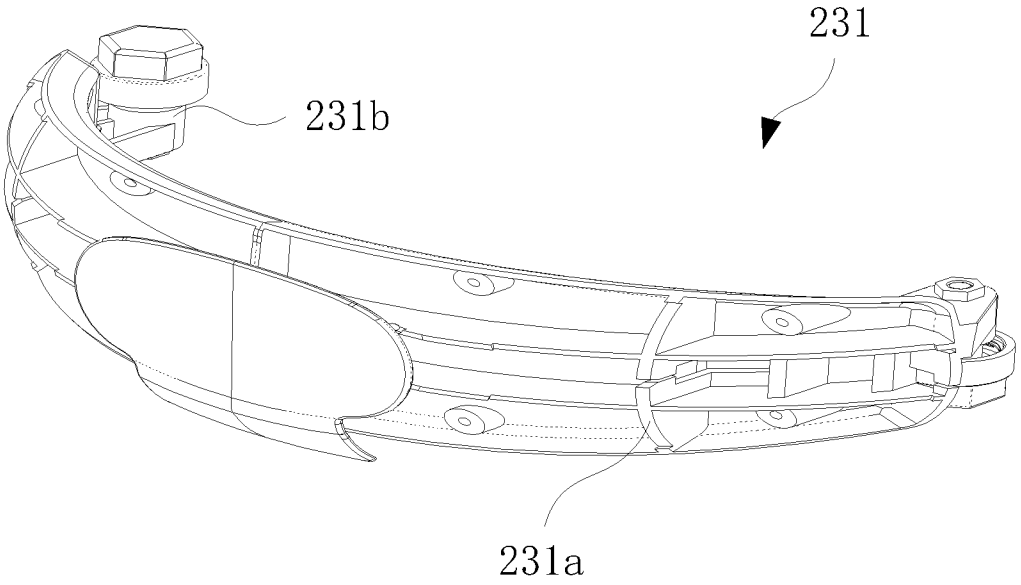
FIG. 9 is a perspective view of an arc-shaped support body in FIG. 8.
Figure 10:
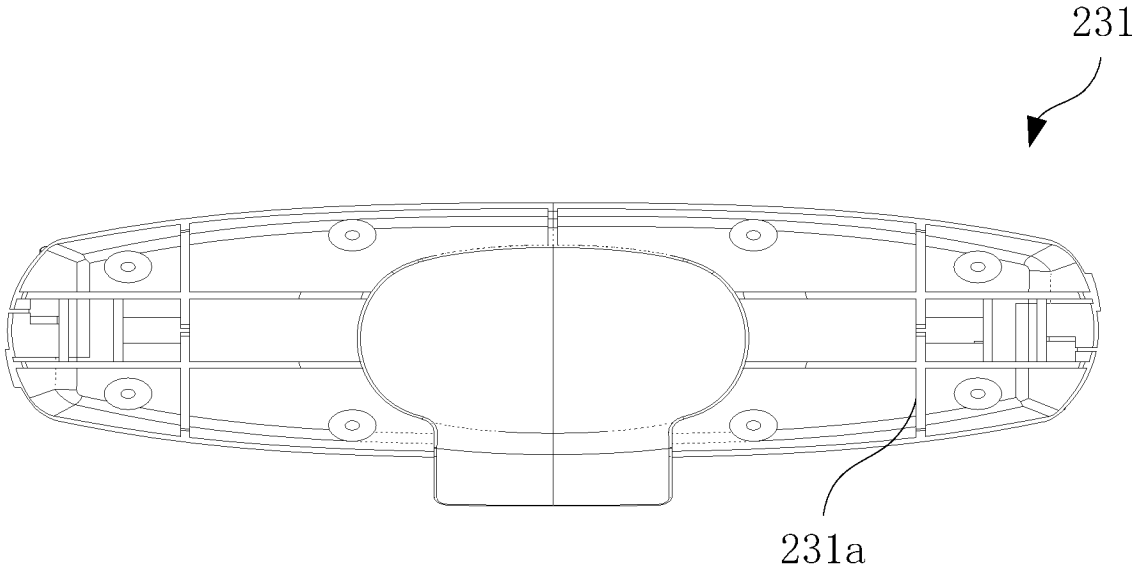
FIG. 10 is a front view of an arc-shaped support body in FIG. 9.

As shown in FIG. 7, the U-shaped filler 220 comprises a first groove 221; as shown in FIGS. 9 and 10, the arc-shaped support body 231 comprises a first protrusion 231*a*; the first groove 221 is detachably connected to the first protrusion 231*a* to fix the U-shaped filler 220 on the arc-shaped support body 231, which allows for easy assembly and disassembly of the travel pillow 300.

Figure 11:
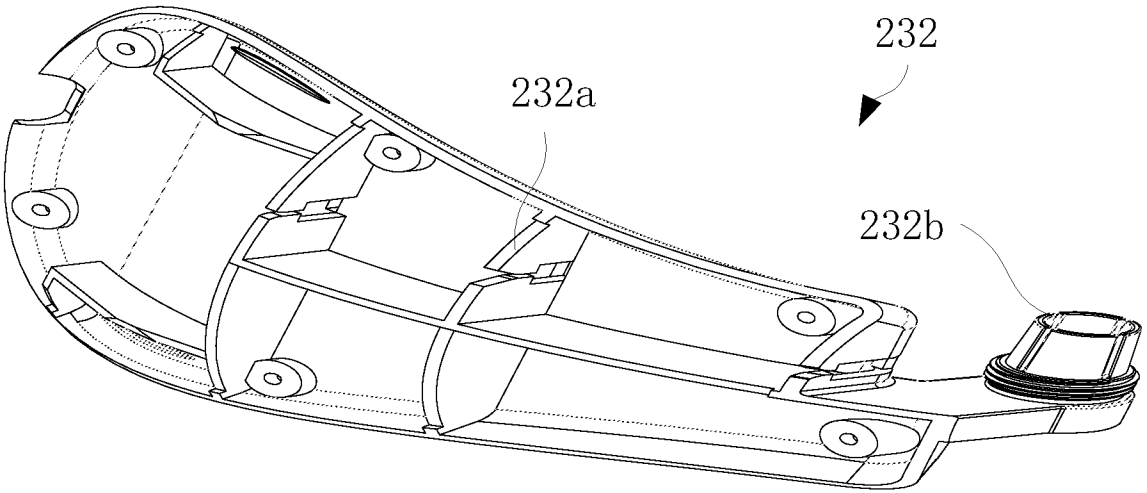
FIG. 11 is a perspective view of an arm in FIG. 8.

As shown in FIG. 7, the U-shaped filler 220 further comprises a second groove 222; as shown in FIG. 11, each of the two arms 232 comprises a second protrusion 232*a*; the second groove 222 is detachably connected to the second protrusion 232*a* to fix the corresponding arm 232 on the U-shaped filler, which allows for easy assembly and disassembly of the travel pillow 300.

Figure 12:
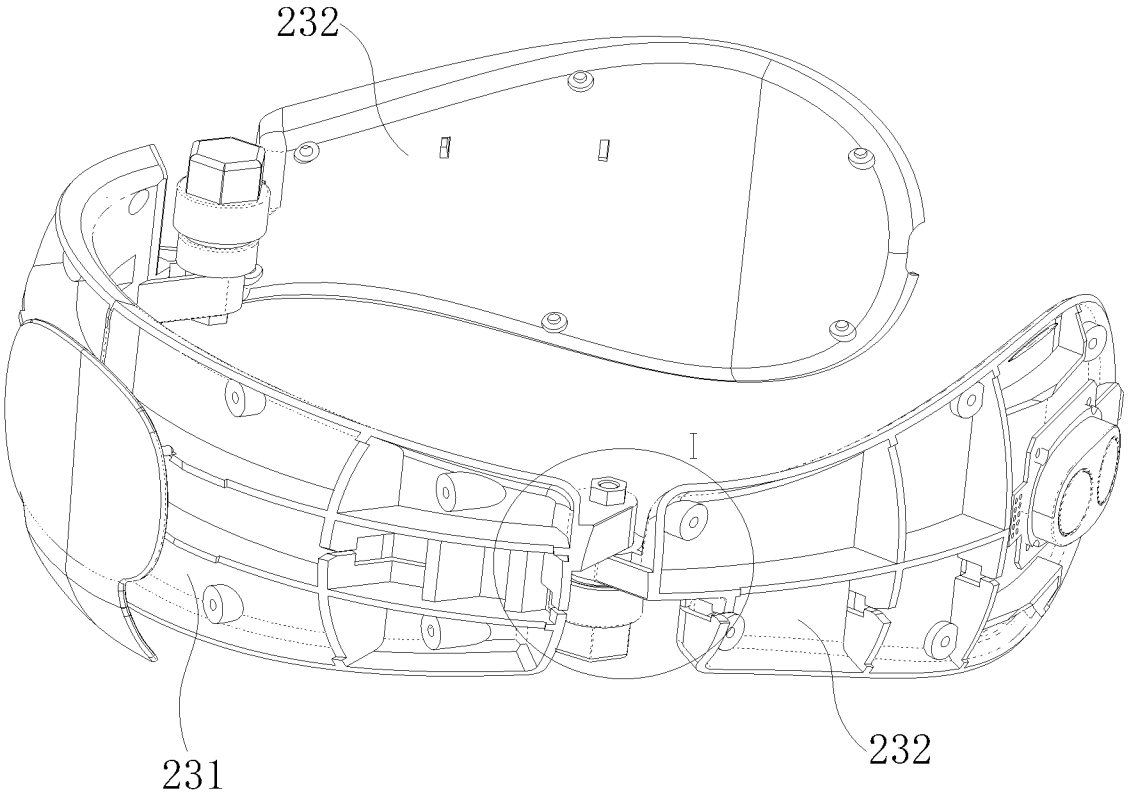
FIG. 12 is a perspective view of a combination of an arc-shaped support body and two arms according to one example of the disclosure.
Figure 13:
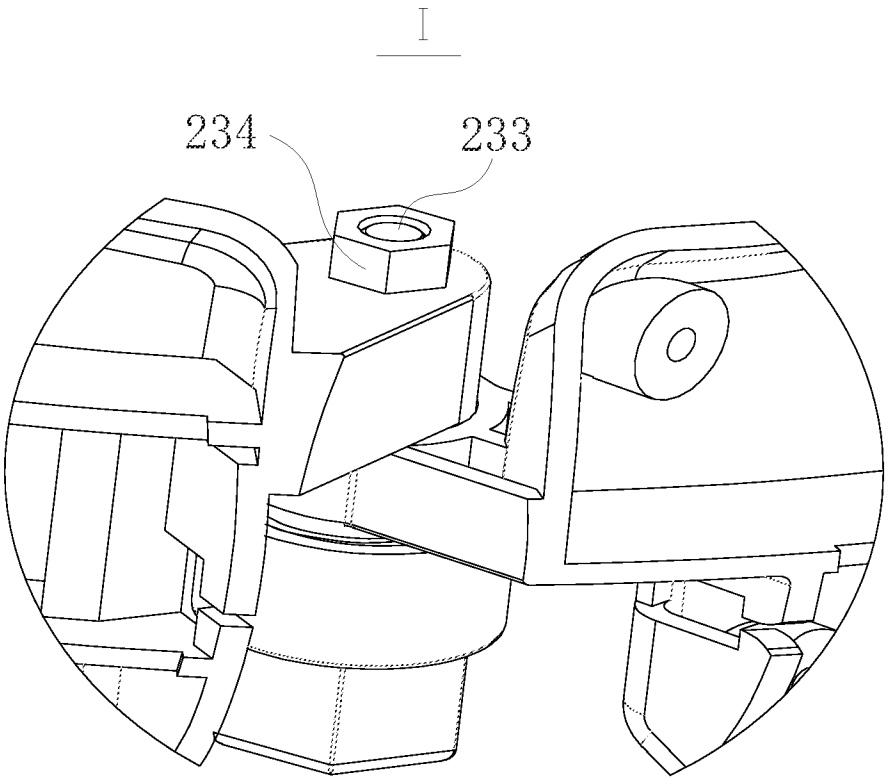
FIG. 13 is an enlarged perspective view of part I in FIG. 12.

Referring to FIGS. 9, 12, and 13, the travel pillow 300 further comprises two rotary connectors each for controlling an included angle between the arc-shaped support body 231 and a corresponding arm 232; each end of the arc-shaped support body 231 comprises a first knuckle 231*b*; and the included angle is controlled to fit a diverse range of neck shapes, thus improving user's comfort.

Figure 14:
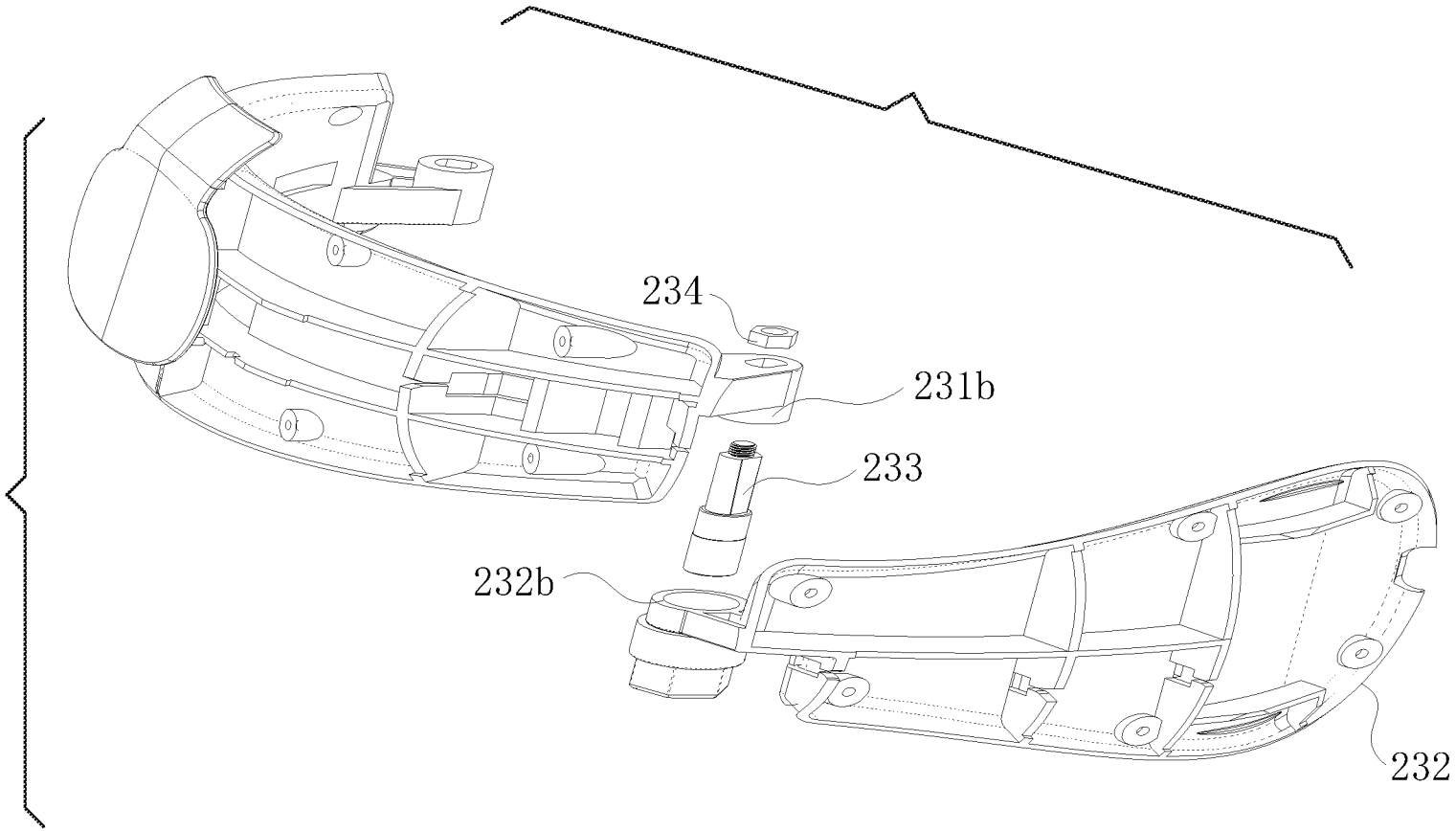
FIG. 14 is an enlarged exploded view of part I in FIG. 12.
Figure 15:
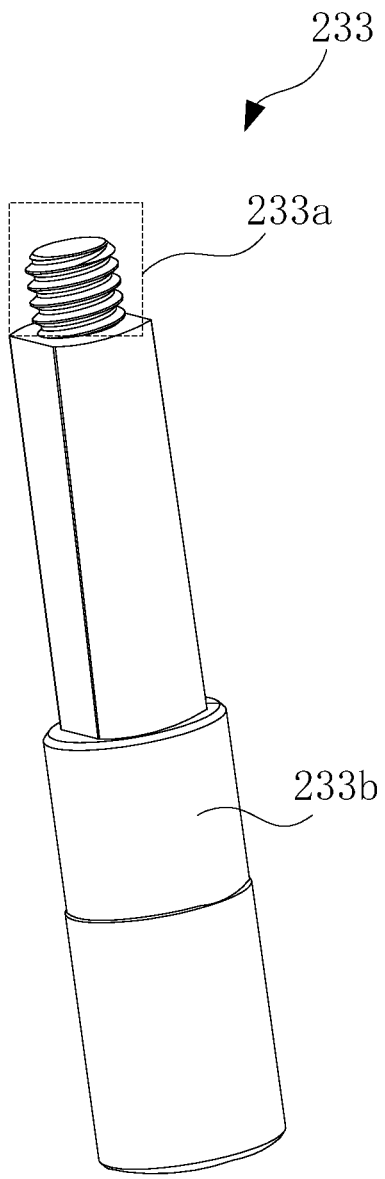
FIG. 15 is a perspective view of a rotating shaft according to one example of the disclosure.

As shown in FIGS. 12 and 13, each arm 232 comprises a second knuckle 232*b*; as shown in FIGS. 14 and 15, the first knuckle 231*b* comprises a through hole, and each rotary connector comprises a rotating shaft 233 and a nut 234; the rotating shaft 233 comprises a threaded end 233*a* and a rotating part 233*b*; the threaded end 233*a* is in threaded connection to the nut 234; the rotating shaft 233 is disposed in the through hole; the first knuckle 231*b* is disposed between the nut 234 and the second knuckle 232*b*; and the rotating part 233*b* is disposed in the second knuckle 232*b*. As one of the two arms 232 rotates, the rotating shaft 233 rotates as well, causing the second knuckle 232*b* to rotate around the rotating part 233*b*; as a result, the included angle between the arc-shaped support body 231 and the corresponding arm 232 is controlled to improve user's comfort. The threaded end 233*a* is in threaded connection to the nut 234 to prevent the rotating shaft 233 from sliding out of the first knuckle 231*b*.

Example 2

Figure 16:
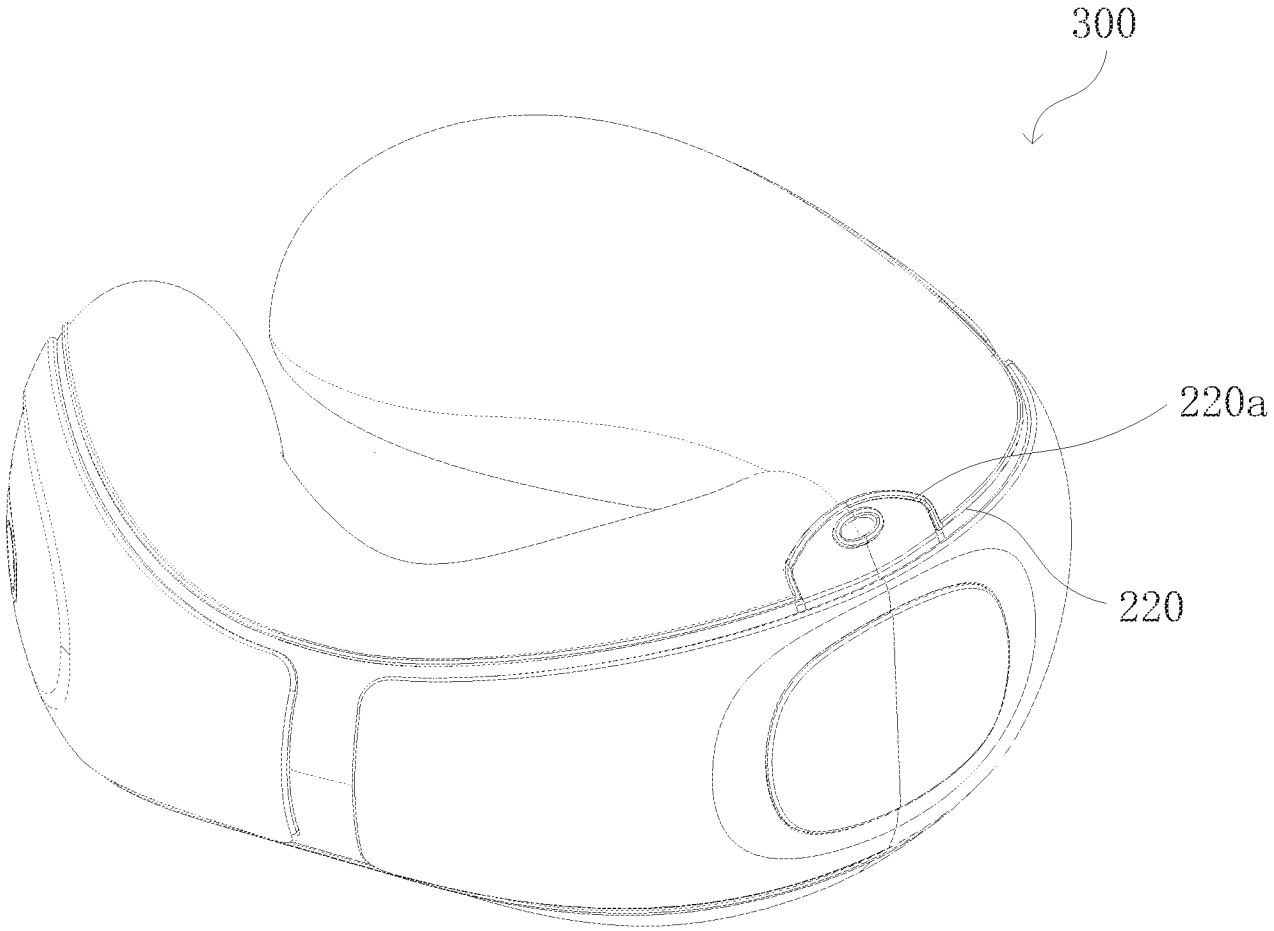
FIG. 16 is a perspective view of another travel pillow according to one example of the disclosure.

A second example of the travel pillow 300 is illustrated in FIG. 16. It is similar to Example 1, except for the following specific differences: the travel pillow 300 further comprises a hang tab 220*a* comprising a hole (not shown); the hang tab 220*a* is disposed on one side of the U-shaped filler 220 that props up the user's head. In use, gravity pulls down the hang tab 220*a*, so that the hang tab 220 covers a zipper in the middle of the U-shaped filler 220 and the U-shaped case 100; when not in use, the travel pillow 300 is hung on a hook through the hang tab 220*a*.

It will be obvious to those skilled in the art that changes and modifications may be made, and therefore, the aim in the appended claims is to cover all such changes and modifications.

What is claimed is:

1. A travel pillow, comprising:

a mounting assembly; and a main body comprising a U-shaped case detachably connected to the mounting assembly;

wherein:

the mounting assembly comprises a cover, a U-shaped filler, and an inner frame; the cover, the U-shaped filler, and the inner frame are disposed sequentially from outside to inside; and the U-shaped filler is detachably attached to the U-shaped case;

the inner frame comprises an arc-shaped support body and two arms;

two ends of the arc-shaped support body comprise two first knuckles, respectively; and the travel pillow further comprises two rotary connectors connected to the two first knuckles, respectively;

each arm comprises a second knuckle; the first knuckle comprises a through hole; each rotary connector comprises a rotating shaft and a nut;

the rotating shaft comprises a threaded end and a rotating part;

the threaded end is in threaded connection to the nut; and the rotating shaft is disposed in the through hole;

the first knuckle is disposed between the nut and the second knuckle;

and the rotating part is disposed in the second knuckle; and the two arms are rotatably disposed on both ends of the arc-shaped support body, respectively; and an included angle between the arc-shaped support body and each arm is adjustable.

2. The travel pillow of claim 1, wherein the mounting assembly is U-shaped and comprises an inner surface in contact with the U-shaped case; and the U-shaped case comprises an outer surface fitting in with the inner surface.

3. The travel pillow of claim 1, wherein the cover comprises an arc-shaped middle and two end parts; and the two end parts are formed integrally with or detachably connected to the arc-shaped middle.

4. The travel pillow of claim 1, wherein the U-shaped filler is detachably connected to the U-shaped case through a zipper; and the U-shaped filler comprises silicone or rubber.

5. The travel pillow of claim 1, wherein the U-shaped filler comprises a first groove; the arc-shaped support body comprises a first protrusion; and the first groove is detachably connected to the first protrusion.

6. The travel pillow of claim 5, wherein the U-shaped filler further comprises a second groove; each of the two arms comprises a second protrusion; and the second protrusion is detachably disposed in the second groove.

* * * * *